United States Patent [19]

Okamoto et al.

[11] 4,149,485

[45] Apr. 17, 1979

[54] APPARATUS FOR FORMING A UNIFORM LIQUID FILM ON A ROLLER

[75] Inventors: Toyoo Okamoto; Takashi Suzuki; Keiichi Maruta, all of Tokyo, Japan

[73] Assignee: Kabushiki Kaisha Ricoh, Tokyo, Japan

[21] Appl. No.: 742,730

[22] Filed: Nov. 17, 1976

Related U.S. Application Data

[62] Division of Ser. No. 465,792, May 1, 1974, Pat. No. 4,011,353.

[30] Foreign Application Priority Data

May 9, 1973 [JP] Japan ..... 4850634

[51] Int. Cl.[2] ..... B05C 11/00; G03G 13/20

[52] U.S. Cl. ..... 118/60; 432/60

[58] Field of Search ..... 432/59, 60, 228, 75; 118/60, 70, 260, 262; 427/428, 366, 194, 278

[56] References Cited

U.S. PATENT DOCUMENTS

| | | | |
|---|---|---|---|
| 1,080,959 | 12/1913 | Eaton | 118/261 X |
| 2,337,747 | 12/1943 | Grobecker | 118/249 |
| 2,482,636 | 9/1949 | Peterson et al. | 118/262 X |
| 2,770,215 | 11/1956 | Knight | 118/260 |
| 3,227,080 | 1/1966 | Hill | 118/260 X |
| 3,268,351 | 8/1966 | Van Dorn | 118/60 X |
| 3,291,466 | 12/1966 | Aser et al. | 432/228 X |
| 3,331,592 | 7/1967 | Cassano et al. | 432/60 |
| 3,718,116 | 2/1973 | Thettu | 118/60 X |
| 3,796,183 | 3/1974 | Thettu | 118/70 |
| 3,809,854 | 5/1974 | Sanders | 432/60 X |
| 3,883,291 | 5/1975 | Cloutier et al. | 118/60 X |

*Primary Examiner*—John McIntosh
*Attorney, Agent, or Firm*—Frank J. Jordan

[57] ABSTRACT

Liquid is applied onto the circumference of a transfer roller by an applicator and thereby onto the circumference of an operating roller. The coefficients of friction in the apparatus are selected so that the transfer roller will be rotated by the operating roller to pick up liquid from the applicator when the thickness of the liquid on the transfer roller is below a selected value, and the transfer roller is prevented from rotating by the applicator when the thickness of the liquid slightly exceeds the selected value so that a uniform liquid film is applied onto the circumference of the operating roller.

7 Claims, 3 Drawing Figures

APPARATUS FOR FORMING A UNIFORM LIQUID FILM ON A ROLLER

This is a division, of application Ser. No. 465,792, filed May 1, 1974, now U.S. Pat. No. 4,611,353.

The present invention relates to an apparatus for applying a uniform liquid film onto a roller.

In order to demonstrate the usefulness of the invention, the invention will be described as being employed in a fixing apparatus for a dry-type electrophotographic copying machine, although its scope is not limited to this particular application.

In the prior art it is known to pass a support sheet of a graphic copy carrying a toner image through a pair of rollers, one of which is heated, to fix the toner image onto the support sheet. In order to prevent transfer of the toner image onto the heated roller, the heated roller is formed with a layer of polytetrafluoroethylene on its circumference. However, polytetrafluoroethylene is not sufficiently effective as a releasing agent, and the problem has persisted. It has been recently proposed to employ a coating of silicone rubber on the heated roller rather than polytetrafluoroethylene, since the releasing property of silicone rubber is greater than that of polytetrafluoroethylene. In order to further increase the releasing property of the heated roller to a practically acceptable level, it has been also proposed to constantly apply a film of silicone oil onto the circumference of the heated roller. In the previously proposed apparatus, it was impossible to accurately control the uniformity and thickness of the silicone oil on the circumference of the heated roller, with the result of erratic fixing effectiveness of the apparatus. Especially, if the thickness of the silicone oil on the circumference of the silicone rubber layer on the heated roller is allowed to become too great, the silicone rubber will swell and streaks will appear on the finished copy in addition to deterioration of the rubber layer. Also, the coefficient of friction between the copy and the silicone rubber layer will become excessively great, and the copy may be physically damaged.

It is therefore an important object of the present invention to provide an apparatus for applying a uniform liquid film onto a roller.

It is another important object of the present invention to provide a fixing apparatus for a dry-type electrophotographic copying machine incorporating an apparatus for forming a uniform liquid film onto a roller by which transfer of a toner image from a support sheet to a heated roller of the fixing apparatus is prevented.

Figure 1:
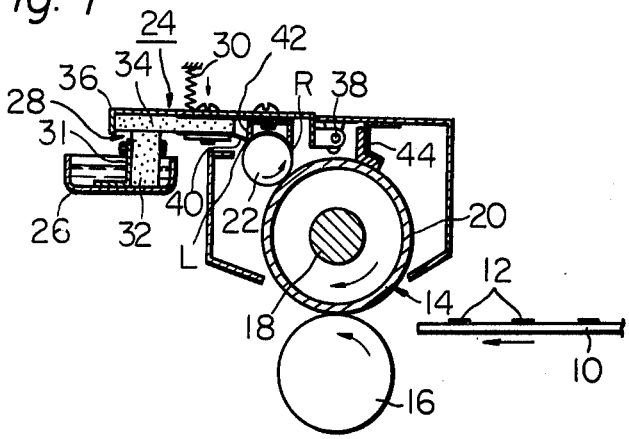
FIG. 1 is a preferred embodiment of an apparatus according to the present invention.

Referring now to FIG. 1, there is shown a portion of an fixing apparatus for a dry-type electrophotographic copying machine. A support medium or copy sheet 10 carrying toner images 12 deposited thereon by electrophotographic means not shown is fed leftward between a heated or first roller 14 and a second roller 16 arranged in parallel with the first roller 14. The first roller 14 may be a hollow metal cylinder having a heater 18 arranged inside to heat the circumference thereof. A layer 20 of silicone rubber is formed on the circumference of the first roller 14 to act as a releasing agent to prevent the toner images 12 from being transferred from the support sheet 10 onto the circumference of the first roller 14.

An apparatus of the present invention generally comprises a transfer roller 22 and an applicator 24 associated therewith. The transfer roller 22 is disposed parallel to the first roller 14 and is in contact with the surface of the layer 20. The applicator 24 comprises a reservoir 26 of silicone oil, and a porous member made of felt 28. The porous member 28 includes a first felt 32 which is partially immersed in the silicone oil in the reservoir 26 and is held stationary by a bracket 31, and a second felt 34 which is separated from the first felt 32 and which is in contact with the first felt 32. The applicator 24 further comprises an arm 36 which carries the second felt 34 and is pivotal about a fixed pin 38. The arm 36 is biased downward by the spring 30 so that the first felt 32 engages with the second felt 34. An element or a piece of porous cloth 40 is maintained in contact with the second felt 34 and is urged against the circumference of the transfer roller 22 by a channel shaped doctor 42. This arrangement is especially advantageous in order to prevent hot and cold transfer of the toner images 12 from the supporting sheet 10 to the layer 20 of the first roller 14 and to the transfer roller 22 when the operating temperature of the first roller 14 exceeds a range within which the silicone rubber layer 20 and silicone oil are perfectly effective in their releasing properties. It is to be noted that the arm 36, the second felt 34, the doctor 42 and the porous cloth 40 constitute a unit which may be detachably mounted at the fixed pin 38. The apparatus of the present invention may further comprises a resilient porous wiper 44, which engages with the layer 20 of the first roller 14 to further smooth the film of silicone oil thereon.

In operation, silicone oil from the reservoir 26 is transferred to the cloth 40 through the felts 32 and 34 by capillary action. If toner images 12 were transferred to the layer 20 and therefrom to the transfer roller 22, they might be transferred back onto another copy upon subsequent rotation of the first roller 14 to imprint the images 12 onto the other copy. With the embodiment shown in FIG. 1, however, the images 12 will be trapped by the cloth 40 at a point R, and thereby removed from the transfer roller 22. The cloth 40 is selected to have a property of trapping images 12 which is greater than that obtainable with known types of felt, and thereby prevents transfer of images 12 under extreme temperature operation of the apparatus. Silicone oil will be applied to the transfer roller 22 by the cloth 40 at a point L.

Assuming that the porous cloth 40 is saturated with silicone oil, the novel principle of the present invention will now be more clearly described.

For the reasons described above, it is desired to maintain a film of silicone oil on the first roller 14 of uniform distribution and uniform thickness of between $0.01\mu$ and $3.0\mu$. The compositions of the layer 20, transfer roller 22, porous cloth 40 and silicone oil are selected so that the coefficient of friction between the porous cloth 40 and the transfer roller 22 is $\mu_1$. The coefficient of friction between the layer 20 and the transfer roller 22 is $\mu_2$ when the thickness of the film on the transfer roller 22 is such that the thickness of film on the first roller 14 is less than a selected value between $0.01\mu$ and $3.0\mu$, and is $\mu_3$ when the thickness is greater than the selected value. In accordance with the present invention, through proper selection of the compositions as described above, the following inequalities hold:

$$\mu_2 > \mu_1$$

$$\mu_3 < \mu_1 \quad (1)$$

When the film thickness is less than the selected value, the coefficient of friction between the layer 20 and the transfer roller 22 is greater than that between the transfer roller 22 and the porous cloth 40, so the transfer roller 22 will be rotated by the first roller 14 against the friction force between the transfer roller 22 and the porous cloth 40, and will pick up silicone oil from the felts 32 and 34 to increase the thickness of the film. When the film thickness slightly exceeds the selected value, the coefficient of friction between the layer 20 and the transfer roller 22 becomes less than that between the transfer roller 22 and the porous cloth 40, and the transfer roller 22 will be prevented from rotating by the porous cloth 40 against the frictional force between the layer 20 and the transfer roller 22. Rotation of the transfer roller 22 will be prevented until the thickness of the film drops slightly below the selected value, at which time the transfer roller 22 will again be rotated by the first roller 14 to increase the film thickness. In this manner, the film thickness is maintained at approximately the selected value at all times.

Figure 2:
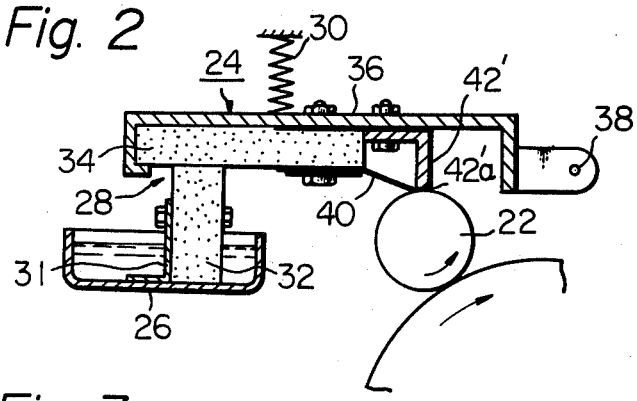
FIG. 2 shows a modification of the apparatus shown in FIG. 1.

A modified form of the apparatus is shown in FIG. 2. The modification of FIG. 2 is identical to that of FIG. 1 except that the channel shaped doctor 42 has been replaced by an L-shaped doctor 42'. The doctor 42' is formed at its lower end with a concave depression 42'*a* to mate with the circumference of the transfer roller 22.

Figure 3:
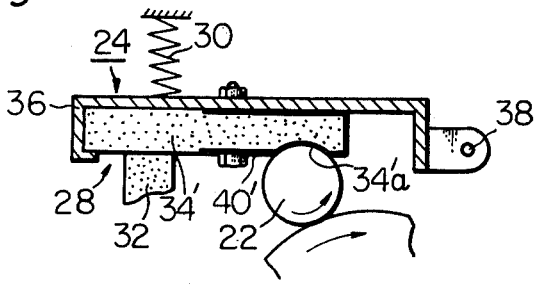
FIG. 3 shows another modification of the apparatus shown in FIG. 1.

FIG. 3 is also similar to FIG. 3 except that the doctor 42 has been omitted completely. Instead, a felt 34' is formed with a concave depression 34'*a* conjugate with the circumference of the transfer roller 22, and a cloth 40' is pressed against the circumference of the transfer roller 22 directly by the felt 34.

It will be understood that a much more uniform silicone oil film can be provided by transfer from the felts 32 and 34 through the cloth 40 or 40' onto the transfer roller 22 than from the felt 34 or 34' directly, and that the wiper 44 will compensate for irregular swelling of the layer 20 caused by overheating.

If desired, the transfer roller 22 and the second roller 16 may have layers of polytetrafluoroethylene formed on their circumference to aid in preventing transfer. The transfer roller 22 is preferably formed of polytetrafluoroethylene but may be formed of metal. The cloth 40 may comprise a nonwoven fabic, and the wiper 44 may comprise a polytetrafluoroethylene felt. Also, although not shown, the apparatus may be provided with a suitable stop mechanism to prevent rotation of the transfer roller 32 while a copy is passing therethrough.

While, in the embodiments of FIGS. 1, 2 and 3, the felts 32 and 34 are shown as being separated from one another, these may be integrally formed if desired.

Although, in the illustrated embodiments, the felt 34 has been shown and described to apply liquid onto the circumference of the transfer roller 22 by means of the porous cloth 40, it is to be noted that the felt 34 may be in direct contact with the transfer roller 22 by omitting the porous cloth 40.

It will now be appreciated from the foregoing description that, in accordance with the present invention, a uniform liquid film is applied onto an operating roller with minimum component parts to provide a simple construction and low manufacturing cost.

Certain specific embodiments of the present invention have been shown and described for the purpose of illustration but it will be apparent that various modifications or changes may be made within the scope of the present invention. It is to be understood therefore that the present invention is not limited to the specific embodiments shown but in its broadest aspects it includes all equivalent embodiments and modifications which come within the scope of the present invention.

What is claimed is:

1. A fixing apparatus for thermally fixing toner images onto a support medium, comprising a first roller, a second roller arranged parallel and adjacent to the first roller so that rotation of at least one of the first and second rollers will feed the support medium between the first and second rollers, a layer of releasing material formed on the circumference of the first roller, a heater to heat the layer, a transfer roller arranged parallel to the first roller and in contact with the layer, and an applicator to apply a lubricant onto the circumference of the transfer roller to be transferred therefrom onto the circumference of the first roller, the applicator comprising a reservoir containing the lubricant, a porous member partially immersed in the lubricant, a porous cloth contacting the porous member and the circumference of the transfer roller, and biasing means to urge the porous cloth against the circumference of the transfer roller, the compositions of the first roller, the transfer roller, the porous cloth and the lubricant being selected so that the coefficient of friction between the first roller and the transfer roller is greater than the coefficient of friction between the transfer roller and the porous cloth when the thickness of the lubricant is less than a predetermined value, and the coefficient of friction between the first roller and the transfer roller is less than the coefficient of friction between the transfer roller and the porous cloth when the thickness of the lubricant on the first roller is greater than the predetermined value such that when the thickness is less than the predetermined value the transfer roller is rotated by the first roller to pick up lubricant from the porous cloth and transfer the same to the first roller, and when the thickness slightly exceeds the predetermined value the transfer roller will be prevented from rotating by the porous cloth until the thickness drops slightly below the predetermined value, whereby a uniform film of lubricant of substantially constant thickness is applied onto the circumference of the first roller.

2. A fixing apparatus according to claim 1, in which the applicator further comprises a doctor by which the porous cloth is held in contact with the circumference of the transfer roller.

3. A fixing apparatus according to claim 2, in which the doctor is formed in channel shape.

4. A fixing apparatus according to claim 2, in which the doctor is formed in L-shaped and in which the doctor has its one end with a concave depression to mate with the circumference of the transfer roller.

5. A fixing apparatus according to claim 1, in which the porous member has a concave depression conjugate with the circumference of the transfer roller and the porous cloth is pressed against the circumference of the transfer roller directly by the porous member.

6. A fixing apparatus according to claim 1, in which the porous member comprises a first felt partially immersed in the liquid and a second felt held in contact with the first felt and the porous cloth, and in which the applicator further comprises an arm pivotal about a fixed pin and supporting the second felt and the porous cloth.

7. A fixing apparatus according to claim 6, in which the arm, the second felt and the porous cloth constitute a unit which is detachably mounted on the fixed pin.

* * * * *